US009045900B2

(12) United States Patent
Swartz

(10) Patent No.: US 9,045,900 B2
(45) Date of Patent: Jun. 2, 2015

(54) BARRIER TO HEAT TRANSPARENT WALL SYSTEM

(71) Applicant: Technical Glass Products, Snoqualmie, WA (US)

(72) Inventor: Dustin Swartz, Kirkland, WA (US)

(73) Assignee: TECHNICAL GLASS PRODUCTS, Snoqualmie, WA (US)

( * ) Notice: Subject to any disclaimer, the term of this patent is extended or adjusted under 35 U.S.C. 154(b) by 0 days.

(21) Appl. No.: 14/044,148

(22) Filed: Oct. 2, 2013

(65) Prior Publication Data

US 2014/0090319 A1 Apr. 3, 2014

Related U.S. Application Data

(60) Provisional application No. 61/709,097, filed on Oct. 2, 2012.

(51) Int. Cl.

| | |
|---|---|
| ***E04B 2/96*** | (2006.01) |
| ***E04B 2/88*** | (2006.01) |
| ***E04B 1/94*** | (2006.01) |
| *E06B 3/58* | (2006.01) |
| *E04B 2/74* | (2006.01) |

(52) U.S. Cl.

CPC ..... *E04B 2/967* (2013.01); *E04B 1/941* (2013.01); *E06B 3/58* (2013.01); *E04B 2/7455* (2013.01); *E04B 2/88* (2013.01)

(58) Field of Classification Search

CPC ... E06B 3/5427; E06B 3/6621; E06B 3/5454; E06B 5/165; E06B 5/161; E06B 2003/26392; E06B 2003/26394; E06B 2003/7078; E06B 3/58; E04B 2/96; E04B 2/90; E04B 2/967; E04B 2/88; E04B 1/941; E04B 2/7455

USPC ..... 52/235, 208–213, 461, 465, 506.01, 52/506.04, 653.1, 655.1, 656.1, 656.3, 52/656.9

See application file for complete search history.

(56) References Cited

U.S. PATENT DOCUMENTS

| | | | | | |
|---|---|---|---|---|---|
| 3,082,848 | A | * | 3/1963 | Keller | 52/417 |
| 3,321,880 | A | * | 5/1967 | Ferrell et al. | 52/235 |
| 4,117,640 | A | | 10/1978 | Vanderstar | |
| 4,141,188 | A | | 2/1979 | Sukolics | |
| 4,418,506 | A | * | 12/1983 | Weber et al. | 52/209 |
| 4,428,171 | A | | 1/1984 | Harbin | |
| 4,750,310 | A | * | 6/1988 | Holcombe | 52/844 |
| 4,996,809 | A | * | 3/1991 | Beard | 52/200 |

(Continued)

FOREIGN PATENT DOCUMENTS

JP 2011-236628 A 11/2011

OTHER PUBLICATIONS

International Search Report for PCT/US2013/063011, mailed Jan. 21, 2014, by the ISA/KR: Korean Intellectual Property Office.

(Continued)

*Primary Examiner* — Jeanette E Chapman

(74) *Attorney, Agent, or Firm* — Klarquist Sparkman, LLP

(57) ABSTRACT

Structurally-glazed curtain wall or store front wall systems can include fire-rated glazing units coupled together by a framing system. The framing system include a plurality of uninsulated vertical mullions with a roll-formed steel profile. The roll-formed steel profile can form a first wall portion and two projecting wall portions that extend from the first wall portion in a generally perpendicular manner.

13 Claims, 20 Drawing Sheets

(56) References Cited

U.S. PATENT DOCUMENTS

| | | | | | |
|---|---|---|---|---|---|
| 5,036,637 | A | * | 8/1991 | Biebuyck | 52/235 |
| 5,067,293 | A | * | 11/1991 | Reynolds | 52/235 |
| 5,481,839 | A | * | 1/1996 | Lang et al. | 52/235 |
| 5,592,795 | A | * | 1/1997 | Rinehart et al. | 52/235 |
| 5,601,888 | A | * | 2/1997 | Fowler | 428/34 |
| 6,141,923 | A | * | 11/2000 | Habicht et al. | 52/235 |
| 6,550,196 | B2 | * | 4/2003 | Braybrook | 52/235 |
| 6,857,233 | B2 | * | 2/2005 | Farag | 52/235 |
| 7,594,364 | B2 | * | 9/2009 | Rinehart et al. | 52/204.593 |
| 8,567,142 | B2 | * | 10/2013 | Swartz | 52/235 |
| 2012/0066991 | A1 | | 3/2012 | Swartz | |

OTHER PUBLICATIONS

Written Opinion for PCT/US2013/063011, mailed Jan. 21, 2014, by the ISA/KR: Korean Intellectual Property Office.

* cited by examiner

FIG. 2A
FIG. 2B
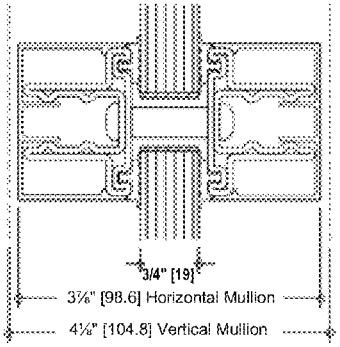
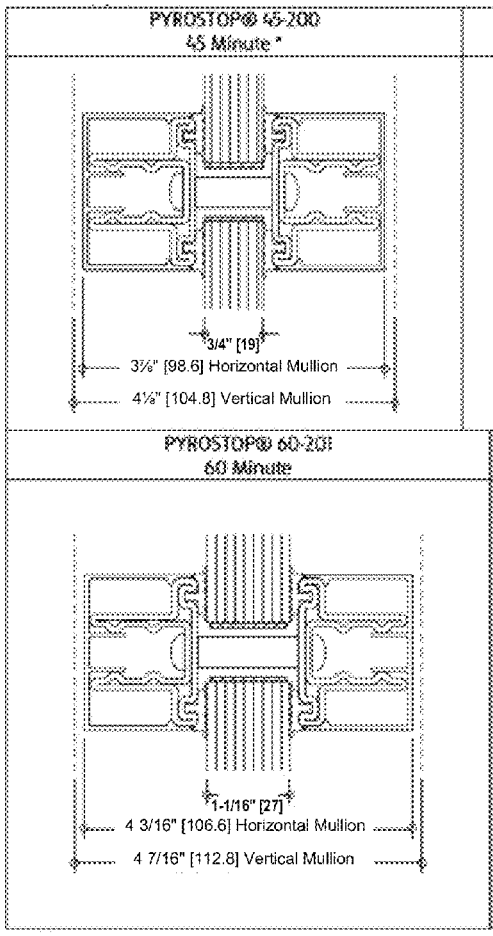
FIG. 2C
FIG. 2D

FIG. 27C
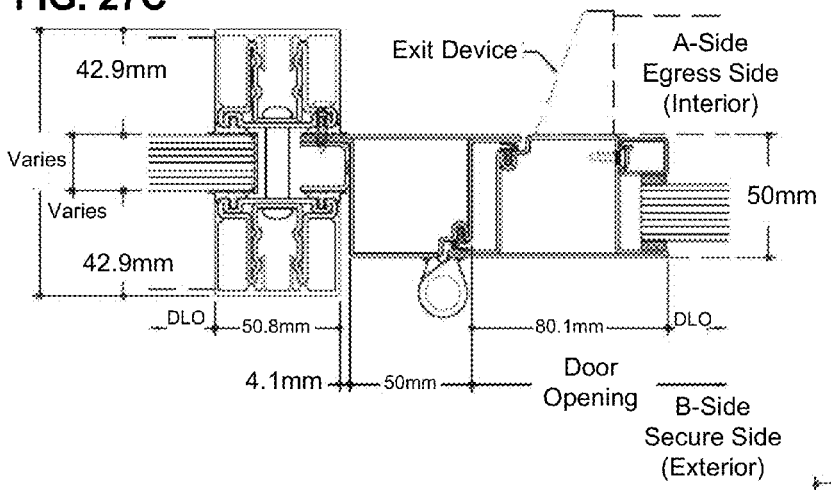
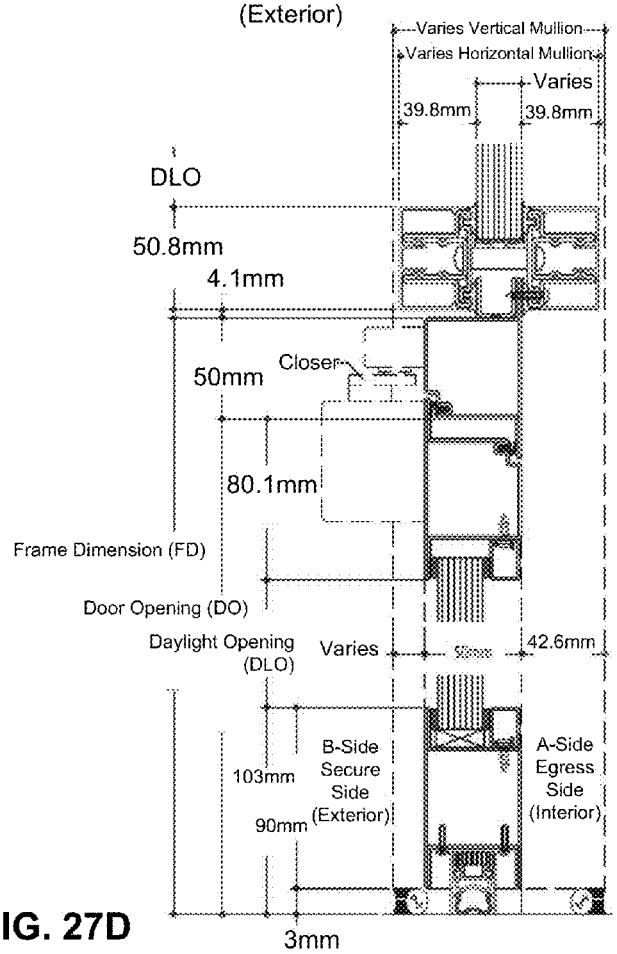
FIG. 27D

BARRIER TO HEAT TRANSPARENT WALL SYSTEM

CROSS-REFERENCE TO RELATED APPLICATION

This application claims the benefit of U.S. Provisional Application No. 61/709,097, which was filed on Oct. 2, 2012 and is incorporated herein by reference in its entirety.

FIELD

This application relates to window construction, and in particular to an assembly construction made from fire rated glass and a fire rated surrounding framing system.

BACKGROUND

Architects and the public at large appreciate the aesthetics of glass and other light transmitting materials used in the built environment, both in interior spaces and for exterior uses. Light transmitting materials that serve both an aesthetic function as well as a structural function are appreciated for their economy and visual effects. A common means prescribed by architects to achieve these goals in building structures is through the use of glass "curtain wall" systems, either for exterior applications or for use in interior spaces.

Although some glass and frame technologies have been developed that are capable of passing applicable fire test and building code requirements, there is always a need to develop systems with improved fire resistance and smaller frame members for improved visual aesthetics.

SUMMARY

In the following embodiments, fire-rated curtain wall or store front wall systems are provided. As described herein, the systems have unique and novel construction elements to maintain structural integrity while barring the transfer of heat beyond acceptable limits as per standards, including ASTM E119/UL263.

In one embodiment, a structurally-glazed curtain wall system comprises a first fire-rated glazing unit coupled to a second fire-rated glazing unit by a framing system. The framing system comprising a plurality of uninsulated vertical mullions with a roll-formed steel profile. The roll-formed steel profile can comprise a first wall portion and two projecting wall portions that extend from the first wall portion in a generally perpendicular manner.

In some embodiments, a silicone gasket system can be positioned between the framing system and the respective glazing units. In other embodiments, a vertical moment brace can be provided and the brace can be an all-bolted assembly between mullions, such that the moment brace is not welded to either mullion. A glass setting platform can be provided that is formed as a combination of horizontal and vertical connecting members. In some embodiments, intermediate anchors can be provided between vertical mullions. The plurality of vertical mullions can be spaced apart from one another to form a generally curved surface.

In other embodiments, a store front system can be provided that includes a plurality of uninsulated vertical mullions with a roll-formed steel profile, a plurality of uninsulated horizontal mullions with a roll-formed steel profile, and a plurality of fire-rated glazing units that are positioned between adjacent vertical and horizontal mullions. The roll-formed steel profile can form a first wall portion and two projecting wall portions that extend from the first wall portion in a generally perpendicular manner.

The systems provided herein can have insulated glazing units that meets fire barrier and thermal transfer limitations of ASTM-E-119 for a period duration of at least 45 minutes, 60 minutes, and/or 120 minutes.

The foregoing and other objects, features, and advantages of the disclosed embodiments will become more apparent from the following detailed description, which proceeds with reference to the accompanying figures.

BRIEF DESCRIPTION OF THE DRAWINGS

FIGS. 2A-2D illustrate various exemplary inter applications with different glazing options and different resulting fire ratings.

FIGS. 27A, 27B, 27C, and 27D illustrate various features of the store front system taken from the areas shown in FIG. 26.

DETAILED DESCRIPTION

Figure 1:
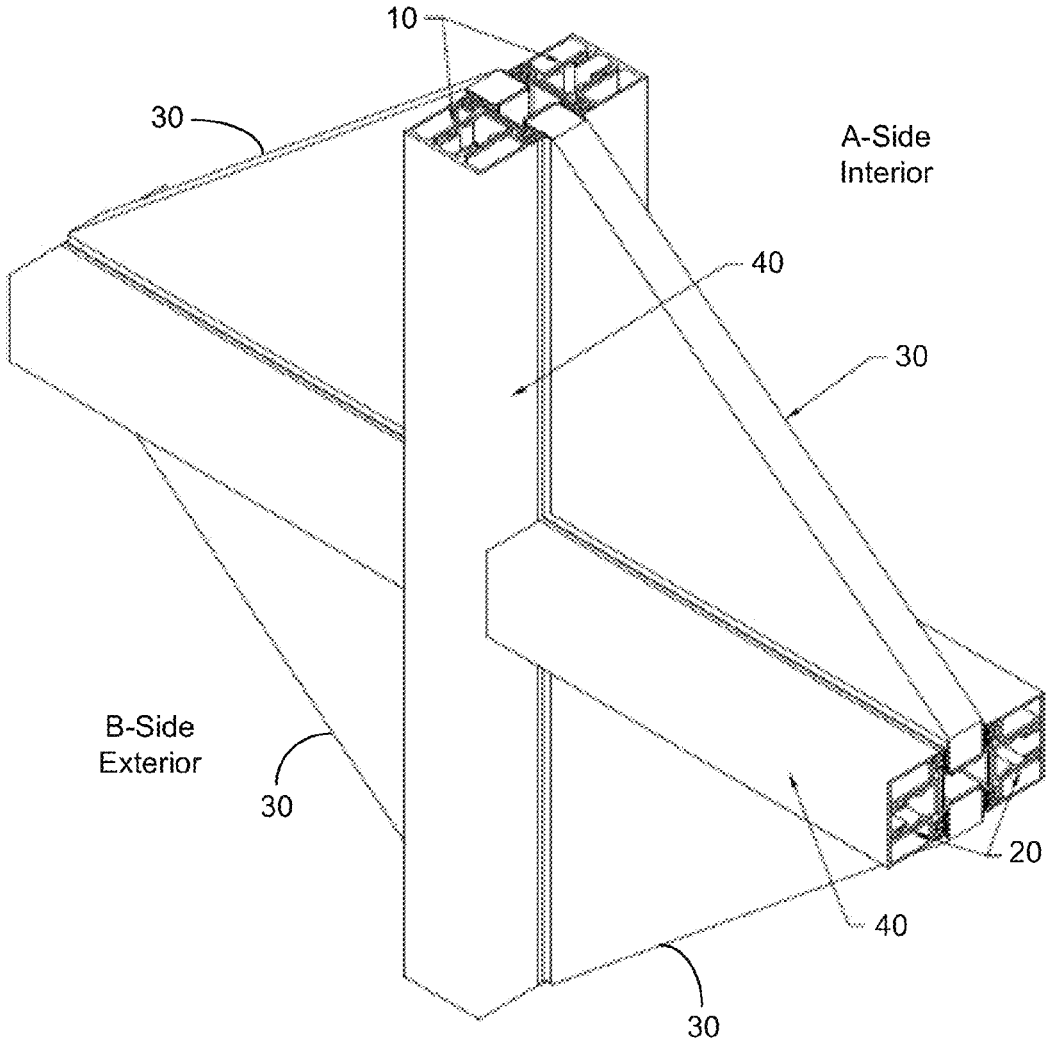
FIG. 1 is a perspective view of a section of a curtain wall, showing vertical and horizontal mullions, and glazings positioned therebetween.

The following description is exemplary in nature and is not intended to limit the scope, applicability, or configuration of the invention in any way. Various changes to the described embodiment may be made in the function and arrangement of the elements described herein without departing from the scope of the invention.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways in which the disclosed system, method, and apparatus can be used in combination with other systems, methods, and apparatuses. However, those ways are readily discernable, based on this disclosure, by one of ordinary skill in the art. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

As used herein, the terms "curtain wall system" or "store front systems" or "framing system" refer to a generally non-structural use of transparent materials for either (1) exterior uses as an outer covering of a building or (2) interior uses as a space divider or for other purposes, such as fire safety.

The use of curtain wall and building design requirements are governed by applicable building codes. In the U.S., this generally means following the International Building Code (IBC) requirements as developed by the International Code Council (ICC). The IBC defines the parameters for building design by addressing items such as "General Building Height and Area Limitations," "Structural Design," "Means of Egress," and "Fire Resistance Rated Construction."

Chapter 7 of the International Building Code govern the materials and assemblies used for structural fire resistance and fire resistance rated construction to safeguard against the spread of fire within a building, or from one building to another. This chapter specifies the various types of fire rated construction required for different building types, in addition to what design allowances are provided for those fire rated areas. Further, the chapter prescribes what standardized tests materials must pass to be classified as "fire rated," and therefore allowable for use in such areas as dictated by Code.

For fire resistance rated construction, these test standards commonly require the applicable building material to withstand fire exposure for a specified amount of time. This can include the resistance to passage of flame, smoke, and radiant and conductive heat from twenty minutes to several hours. In addition, these test standards commonly require the assembly be impacted by water sprayed from a two-man fire hose immediately after exposure to the fire. Such exposure is intended to provide a means of testing the materials resistance to the impact, erosion, and cooling effects of the water; and eliminates inadequate materials or constructions. The inability to pass such test standards generally prohibits their use in building areas required by the IBC to utilize fire rated materials.

Traditional curtain wall materials (e.g., those that include conventional glass, framing members, anchoring systems, and other accessories) are unable to pass the fire test standards described above, and therefore may not be considered as fire rated construction. The inability of typical curtain wall construction to meet these standards is due to numerous reasons. For example:

1. Framing members and window glass cannot withstand the high temperatures and pressures created by the fire tests.

2. Framing members and window glass cannot withstand the impact, erosion and cooling (thermal shock) of the mandatory 'fire hose stream test' prescribed in standards.

3. Framing members and window glass cannot provide the barrier to radiant and conductive heat transfer prescribed in standards.

The following embodiments illustrate glazed framing systems that meet applicable building code, including requirements for classification as a fire rated assembly.

The framing systems disclosed herein comprise frames with fire-rated glass (e.g., Pilkington Pyrostop® fire-rated glass) that provide a barrier to radiant and conductive heat transfer, allowing for unlimited areas of glazing in fire separations. In some embodiments, the frame comprises high strength steel sub-frame that is only 2 inches wide, yet has sufficient strength for tall spans, while the aluminum cover system provides a durable and flexible system with various anodizing and coating options. Such framing systems provide various features and advantages including:

- Fire ratings of 45/60/120 minutes
- Extruded aluminum framing with crisp edges and narrow sightlines
- Custom aluminum face caps available to meet project needs
- Easy installation
- Frames supplied "K-D" (knock-down) ready for installation
- Incorporates large individual panes of fire-rated glass (such as Pilkington Pyrostop® glass, composed of low-iron Pilkington OptiWhite™ glass)
- Compatible with Fireframes Designer Series or Fireframes Heat Barrier Series full-glass doors from TGP
- Finish available in anodized aluminum or painted at the factory to match desired color scheme.
- Designer Series doors can match aluminum finish
- Door hardware available to fit functional requirements.
- Passes wall assembly test standard UL 263/ASTM E119 for 60 and 120 minute ratings. (All ratings referred to herein are those ratings in effect at the time this application was filed. For example, ASTM E119 refers to ASTME E119-12A, which was in effect as of July 2012.)

FIG. 1 illustrates a system overview of a curtain wall system that includes fire rated glazing. As shown in FIG. 1, the system includes vertical mullions 10 and horizontal mullions 20, and glazings 30 positioned therebetween. Horizontal and vertical cover caps 40 can be provided.

Sizing guidelines for the system are set out below in Table 1:

TABLE 1

| Sizing Guidelines | | | |
|---|---|---|---|
| Frame Rating | Maximum Exposed Glass Area Per Frame | Maximum Exposed Glass Single Dimension | Maximum Frame Size |
| 45 minutes | 31.25 sq. ft. (4,500 sq. in.) | 95-¼" | 144" × 144" |
| 60 minutes | 31.25 sq. ft. (4,500 sq. in.) | 95-¼" | n/a |
| 120 minutes | 26.33 sq. ft. (3,792 sq. in.) | 110 5/16" | n/a |

In one embodiment, the framing systems can utilize Pilkington Pyrostop® fire-rated glazing options to complement the framing system. Pilkington Pyrostop® fire resistant glass offers up to 2 hour fire rating and up to a Level III bullet resistance rating. It can also be combined with other glazing products to achieve nearly any level of security protection. The framing systems described herein can be provided with 45 minute fire rated windows and 60 or 120 minute transparent glass wall applications. Wall applications are UL rated as per UL263/ASTM E-119 and allow for large expanses of glass and frame. 45 minute window systems are classified as an Opening Protective as per UL 9, ASTM E2010 with a maximum overall frame size of 144"×144."

FIGS. 2A-2D illustrate various exemplary interior applications with different glazing options and different resulting fire ratings. As shown in FIGS. 2A-2D, the mullions can comprise a roll-formed steel profile and a silicone gasket system can be positioned between the glazing and mullions. Exemplary sizing options are illustrated in FIGS. 2A-2D.

Table 2 below illustrates various fire rating designations for the systems disclosed in FIGS. 2A-2D:

TABLE 2

| | Manufacturer's Designation | | | |
|---|---|---|---|---|
| | 45-200 | 60-101 | 60-201 | 120-106 |
| Fire Rating (minutes) | 45 | 60 | 60 | 120 |
| Glazing Type | Single | Single | Single | IGU |
| Application | Interior **Opening Protective | Interior *Wall Assembly | Interior *Wall Assembly | Interior *Wall Assembly |
| Nominal Thickness | ¾" 19 mm | ⅞" 23 mm | 1 1/16" 27 mm | 2 3/16" 55 mm |
| Weight-Pounds per Square Foot (approx.) | 9.22 | 10.85 | 12.90 | 22.9 |
| Daylight Transmission (approx.) | 84% | 88% | 88% | 75% |
| STC Rating (dB) (approx.) | 40 | 41 | 44 | 46 |
| UL-752 Bullet Resistance Rating | | | Level I | |

NOTES:

*UL Listed as Wall Assembly as per ASTM E119 UL 263

**Opening Protective - Limited size IBC Fire Window Assembly Fire Protection Rating Table 715.4. Maximum frame size is 144" × 144"

Figure 3:
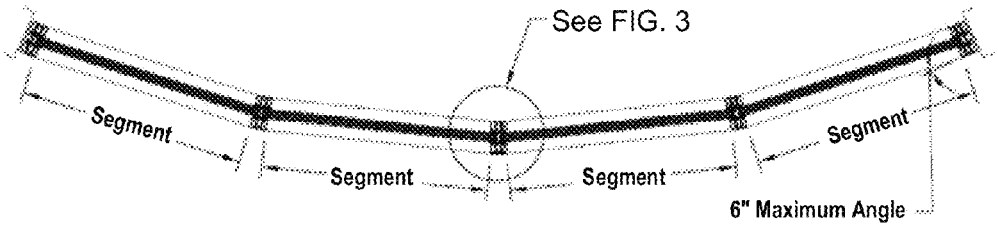
FIG. 3 illustrates exemplary angled segments of frame members.
Figure 4:
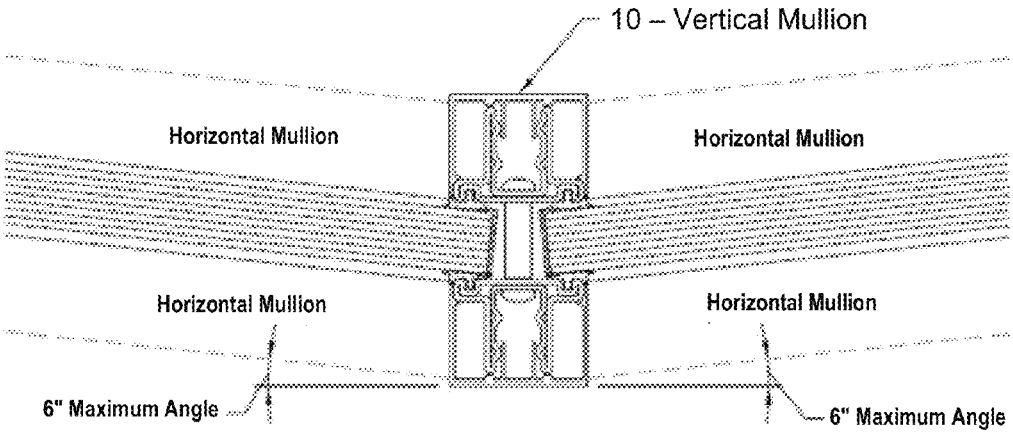
FIG. 4 illustrates a detailed view of a portion of the exemplary angled segments shown in FIG. 3.

FIGS. 3 and 4 illustrate exemplary angled segments of windows and frame members. In particular, in some embodiments, the system can be angled up to a 6 degree angle between segments to provide a generally curved outer surface. FIG. 3 illustrates an angled frame layout of several segments of glazing and frame members, while FIG. 4 illustrates a close-up view of a portion of a vertical mullion illustrate the angled window frame detail.

Figure 5:
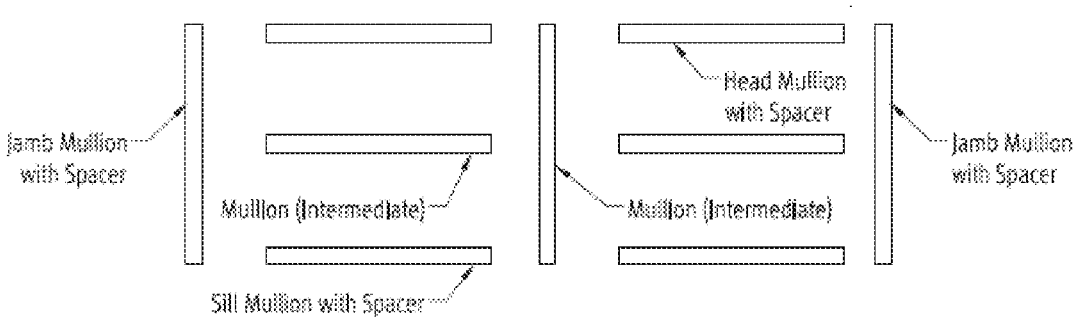
FIG. 5 illustrates a typical mullion layer for a framing system as described herein.
Figure 6:
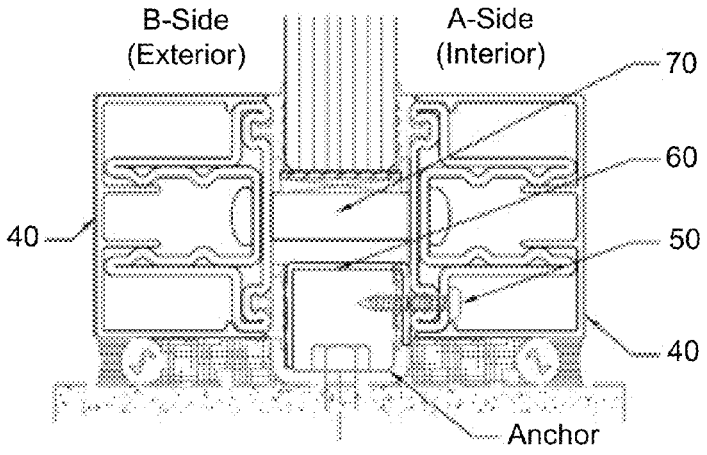
FIG. 6 illustrates A-Side and B-Side elements of an exemplary framing system.

FIG. 5 illustrates a typical mullion layer for a framing system as described herein. FIG. 6 illustrates A-Side and B-Side elements of an exemplary framing system. For convenience, in some figures the different sides of the framing system are identified with either an "A-Side" or a "B-Side." In some embodiments, parts can be marked with an A-Side or B-Side to indicate proper positioning of the framing system. If so marked, parts marked with an A should be installed on an interior side, while parts marked with a B should be installed on an exterior side. A fastener 50 (e.g., a screw) can secure a spacer 60 on its A-Side. One or more cover caps 40 can be provided on both the A-Side and B-Side of the framing system. A connecting brace 70 can be attached to the A-Side.

The vertical mullions shown in FIG. 6 are formed with a rolled pattern that, when viewed from above as shown in FIG. 6, can comprise a first side that has two projecting portions extending generally perpendicular from the first side. This arrangement is also illustrated in other figures, including, for example, FIG. 7C.

As shown in FIG. 6, a cover cap can comprise a pair of extending members that project between the two projecting portions of the vertical mullions. The facing surfaces of the two projecting portions can comprise a non-straight surface, such as the partially curved surface shown in FIG. 6. As shown in FIG. 6, a connecting brace 70 can connect the two vertical mullions and a fastener 50 can be used to secure the interior vertical mullion to an anchor member.

Figure 7A:
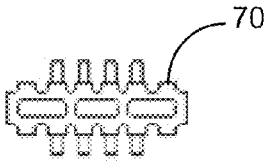
FIGS. 7A-7C illustrate an exemplary vertical moment brace for use with a framing system.
Figure 7B:
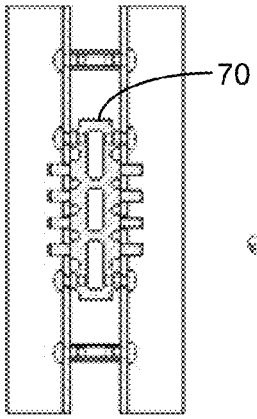
Figure 7C:
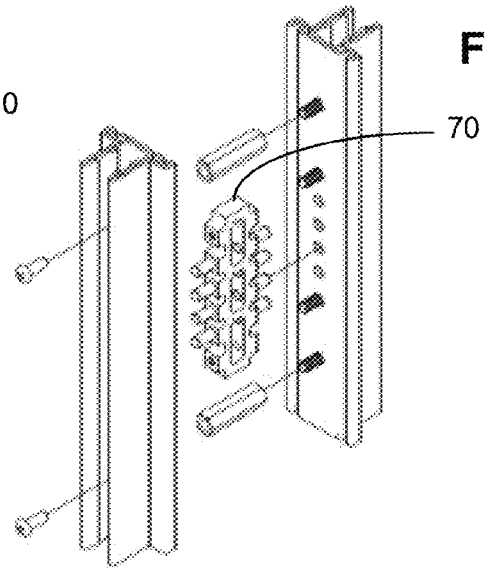

Assembly of the framing systems described herein can be achieved without welding. For example, as shown in FIGS. 7A-7C, a connecting brace 70 (e.g., a moment brace) can be bolted to both mullions for an all bolted assembly. The brace 70 is preferably configured to connect the two mullion halves together in a structurally composite manner while reducing the amount of heat that can pass through in the event of a fire.

Figure 8:
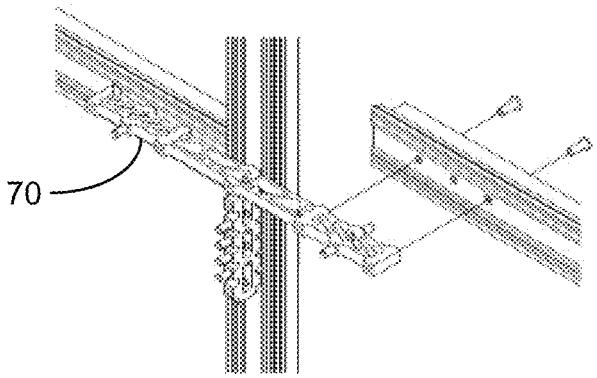
FIG. 8 illustrates an exemplary connecting brace for use with a framing system.
Figure 9:
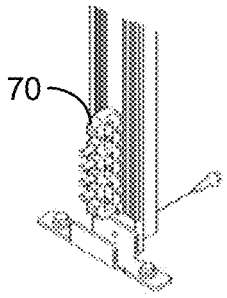
FIG. 9 illustrates an exemplary connecting anchor for use with a framing system.

FIG. 8 illustrates an exemplary connecting brace 70 for use with a framing system. As shown in this figure, a glass setting platform can be formed with a combined horizontal and vertical connection. The glass setting platform bears the vertical load of the glazing and also acts to connect the vertical mullions with the horizontal mullions, while reducing the amount of heat that can pass through in the event of a fire. FIG. 9 illustrates an exemplary connecting brace 70 (e.g., anchor) for use with a framing system. As shown in this figure, intermediate anchors can be provided at vertical mullion locations.

When installing the framing system, parts marked with a "A" are to be installed on the interior side, while parts marked with a "B" are to be installed on the exterior side. Framing parts should be arranged so that vertical mullions with a spacer attached are to be installed at the jambs and the horizontal mullions with the spacer attached are to be installed at the head and sill.

Figure 10:
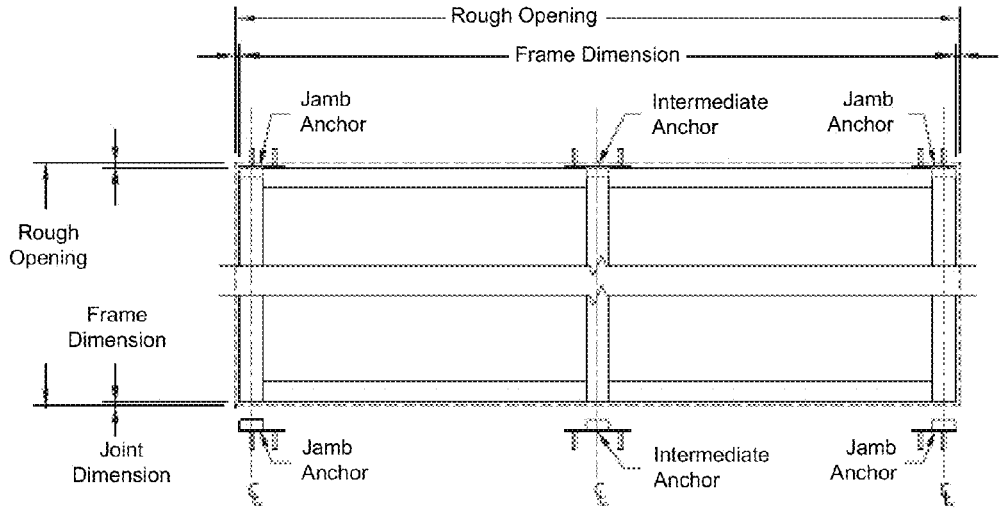
FIG. 10 illustrates a typical mullion centerline layout.
Figure 11:
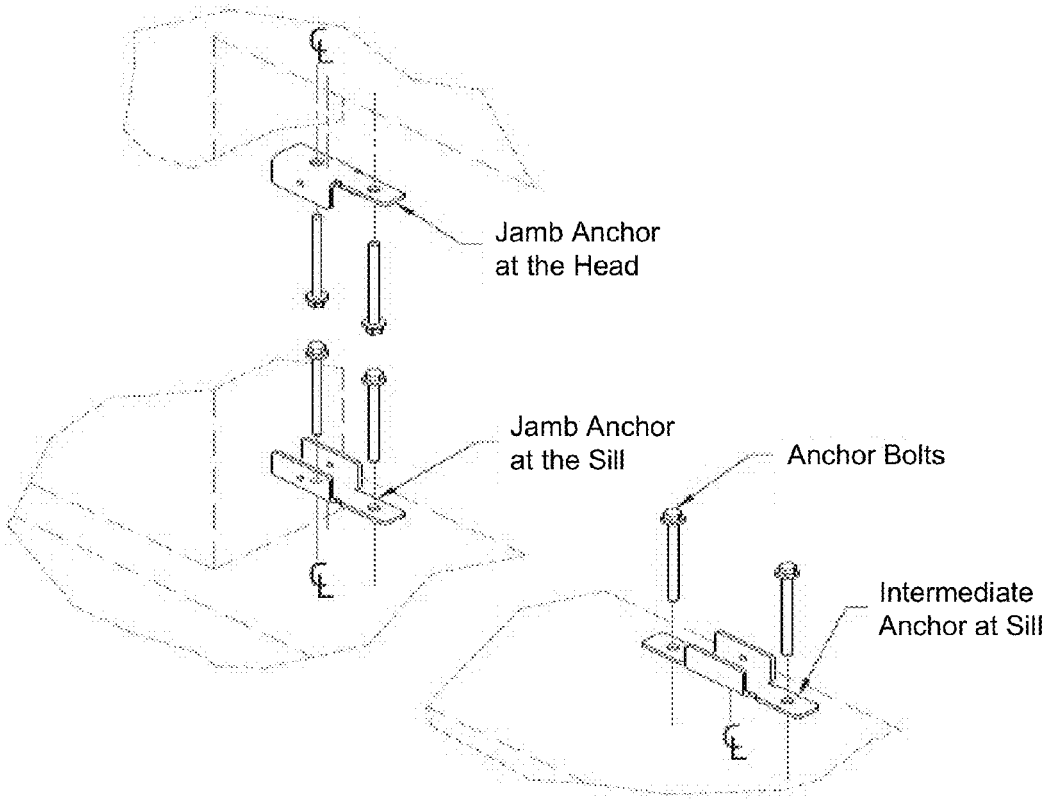
FIG. 11 illustrates close up views of an exemplary installation of intermediate anchors and jamb anchors.

FIG. 10 illustrates a typical mullion centerline layout with indications as to where a plurality of anchors (e.g., jamb anchors and intermediate anchors) can be positioned. FIG. 11 illustrates close up views of an exemplary installation of intermediate anchors and jamb anchors. To ensure proper elevation of the vertical mullions, shim can be installed under the sill anchors. Preferably any such shims are steel shims; however, other non-flammable materials that are able to withstand the weight of the system may be used.

Figure 12:
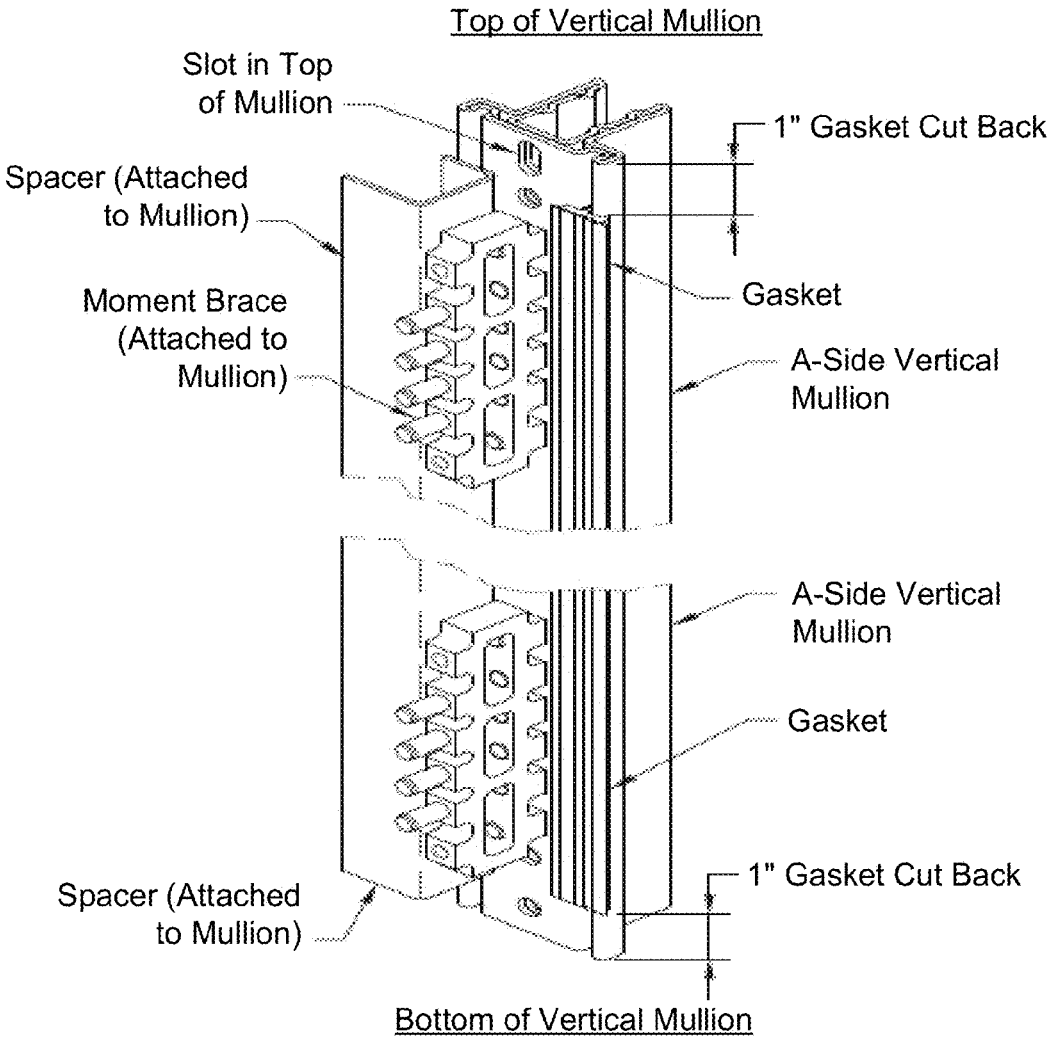
FIG. 12 illustrates A-Side vertical mullions with gaskets and moment braces already installed.

FIG. 12 illustrates A-Side vertical mullions with gaskets and moment braces already installed. If desired, the mullions located at the jambs can also have the spacers attached. As shown in FIG. 12, the top of the vertical mullions can be indicated by a slot and the gaskets on the vertical mullions can be cut back (e.g., 1 inch) to accommodate the anchors at head and sill.

Figure 13:
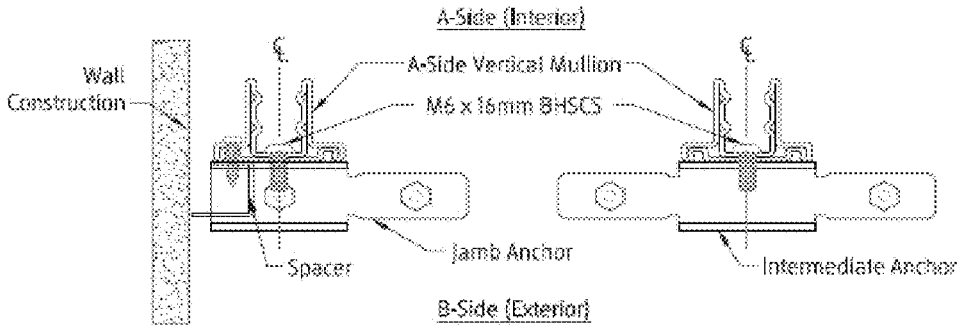
FIG. 13 illustrates a close up view of the vertical jam and intermediate mullions.

FIG. 13 illustrates a close up view of the vertical jam and intermediate mullions. As shown in FIG. 13, the spacer side of the mullion can be oriented toward the surrounding wall condition. One or more fasteners (e.g., screws) can be used to install the vertical mullions to the head and sill anchors.

Figure 14:
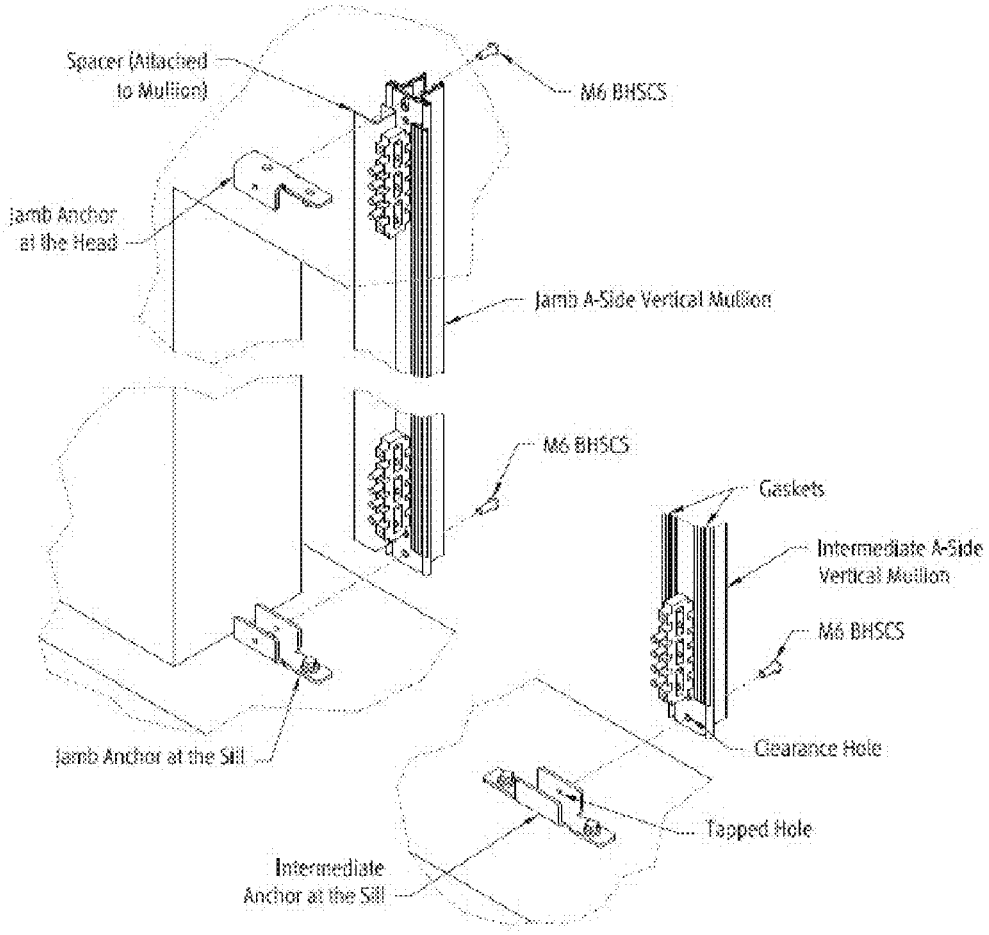
FIG. 14 illustrates an exemplary installation of A-Side vertical mullions.

FIG. 14 illustrates an exemplary installation of A-Side vertical mullions. As shown in FIG. 14, the clearance holes in the bottom of A-Side vertical mullions can be aligned with the tapped holes in the anchors and secured with fasteners (e.g., screws). Then, the aligned slotted hole at the top of each mullion can be aligned with the tapped hole in the head anchors and fastened thereto.

Figure 15:
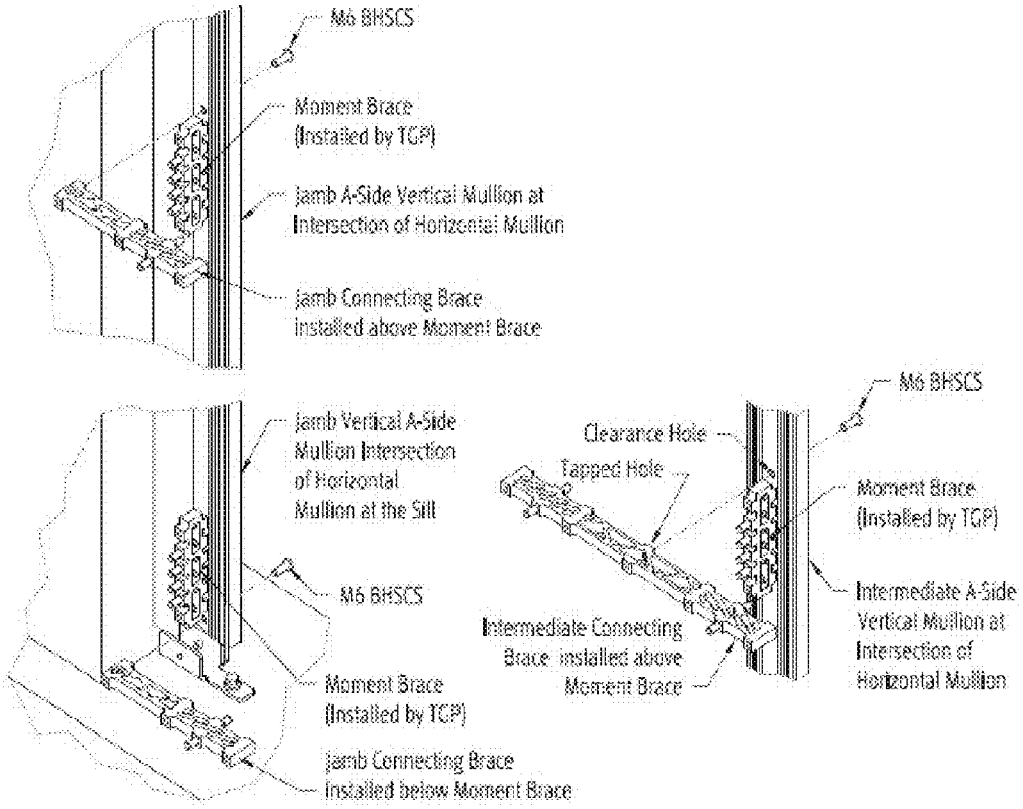
FIG. 15 illustrates an exemplary installation of a connecting and moment braces.

FIG. 15 illustrates an exemplary installation of a connecting and moment braces. As shown in FIG. 15, the horizontal connecting braces can be used in the installation of the horizontal mullions onto the vertical mullions at the intersection of all horizontal mullions.

Figure 16:
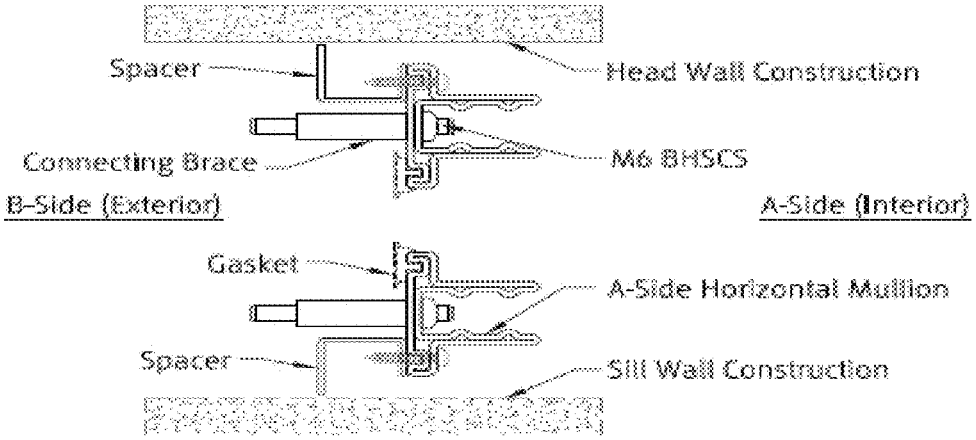
FIG. 16 illustrates an exemplary installation of A-Side head and sill horizontal mullions.

FIG. 16 illustrates an exemplary installation of A-Side head and sill horizontal mullions. As shown in FIG. 16, the spacer side of the mullion should be oriented toward the surrounding wall condition.

Figure 17:
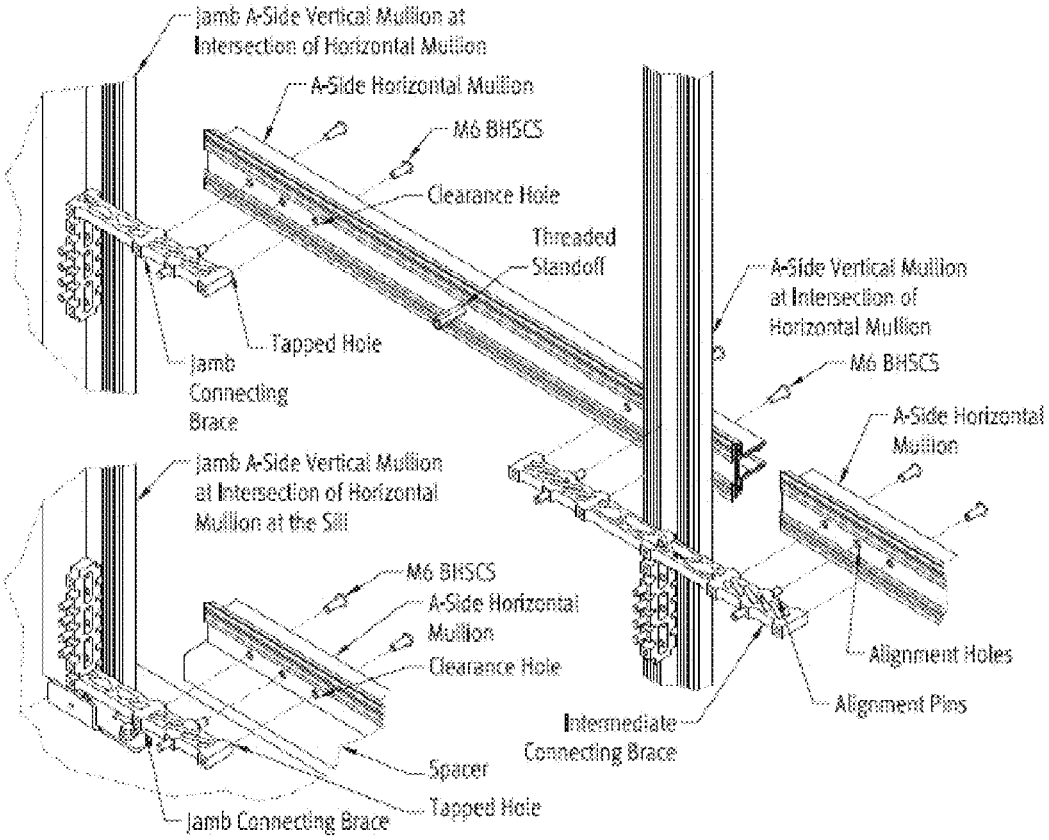
FIG. 17 illustrates an exemplary installation of A-Side horizontal mullions.

FIG. 17 illustrates an exemplary installation of A-Side horizontal mullions. As shown in FIG. 17, holes in each end of the A-Side horizontal mullions can be aligned with alignment pins in the connecting braces and pressed securely into place. Once both ends of the horizontal mullions are fully seated, fasteners (e.g., screws) can be inserted through the clearance hole in the horizontal mullions and into the tapped holes in the connecting brace and then secured with fasteners.

Figure 18:
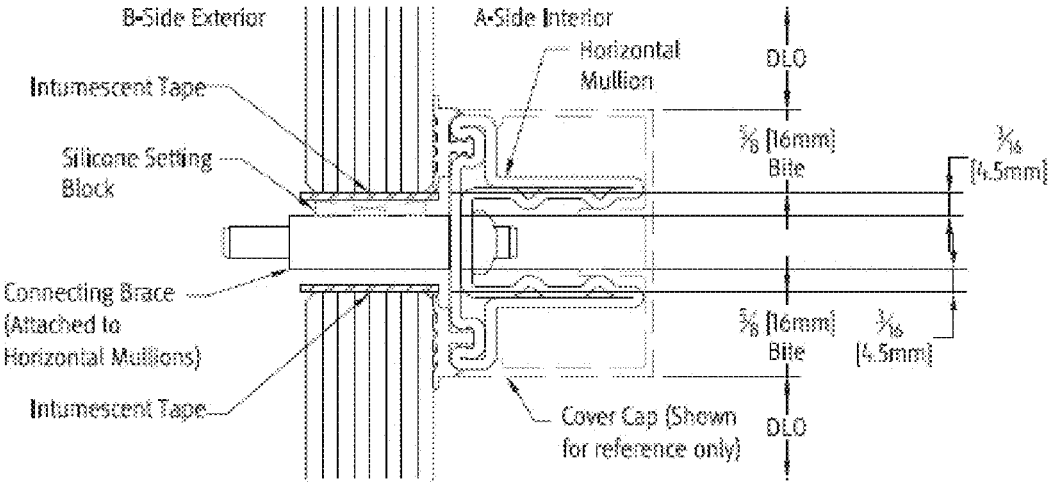
FIG. 18 illustrates an exemplary glazing installation.
Figure 19:
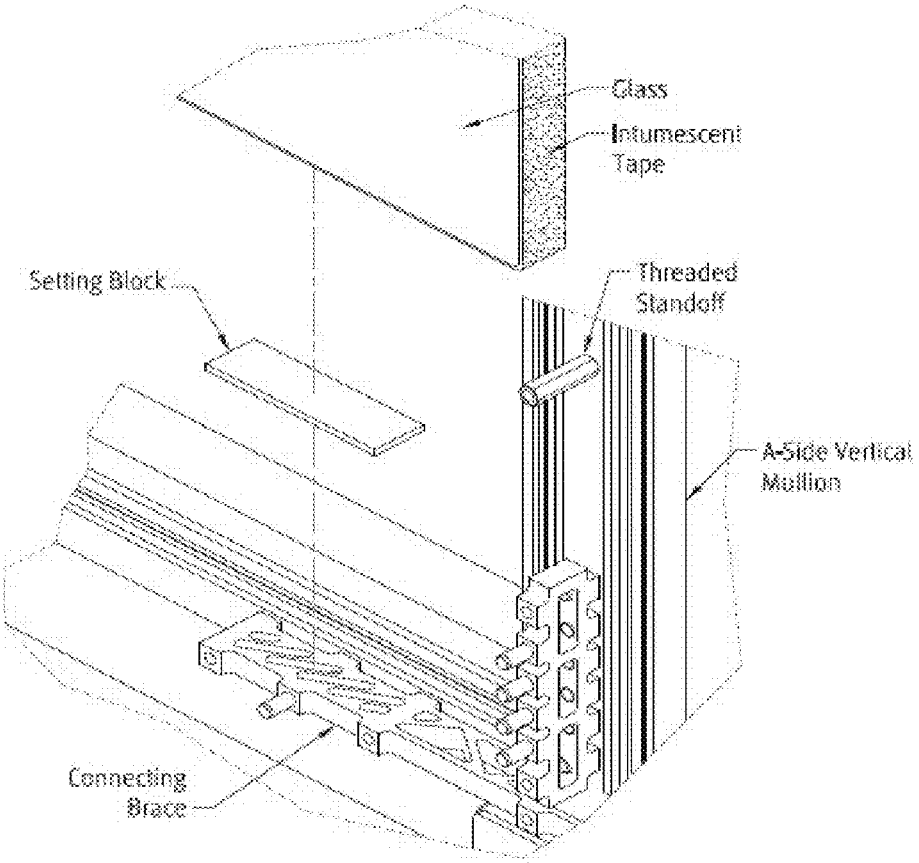
FIG. 19 illustrates additional features of the glazing installation.
Figure 20:
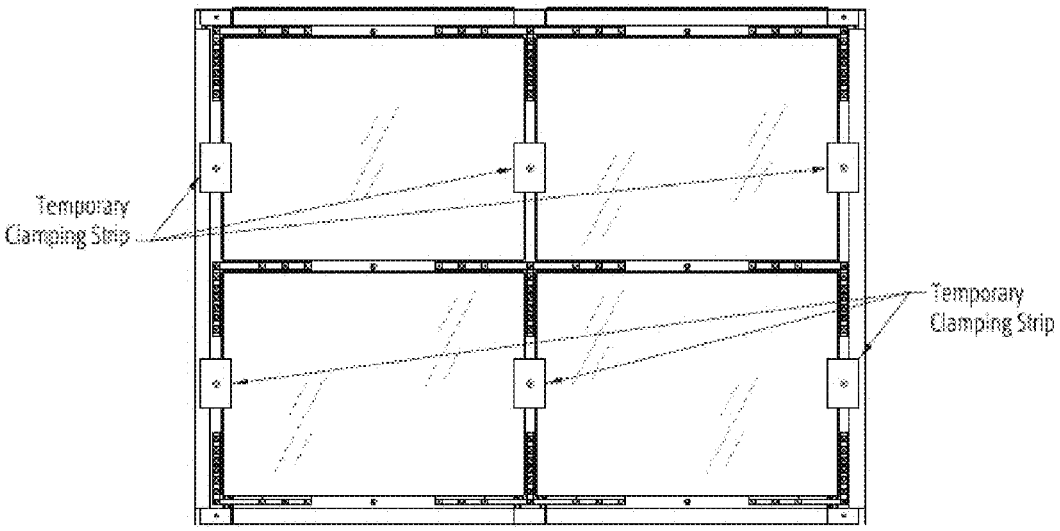
FIG. 20 illustrates additional features of the glazing installation.

FIG. 18 illustrates an exemplary glazing installation. As shown in FIG. 18, in some embodiments, the glass bite can be about ⅝ inch from glass to gasket. Intumescent tape can be installed around the entire perimeter of the glass. In addition, silicone setting blocks can be placed onto the connecting braces. FIGS. 19 and 20 illustrate additional features of the glazing installation. For example, as shown in FIG. 20, temporary clamping strips can be installed on the vertical mullions to temporarily capture the glass until mullions can be installed. Fasteners (e.g., screws) can be inserted into the clearance hole in the temporary clamping strip then into the tapered holes in the threaded standoff on the vertical mullion and secured.

Figure 21:
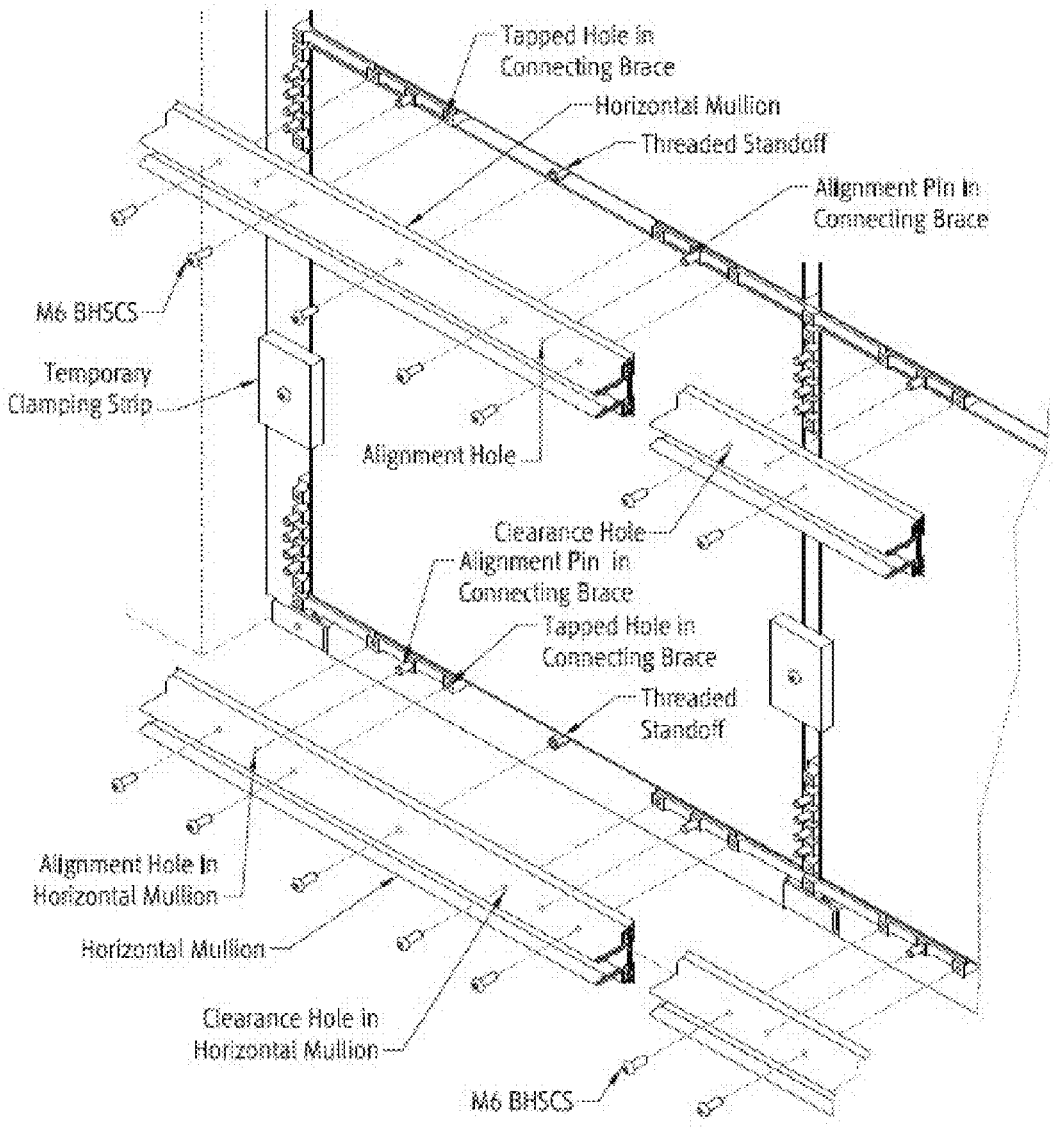
FIG. 21 illustrates an exemplary B-Side horizontal mullion installation.

FIG. 21 illustrates an exemplary B-Side horizontal mullion installation. As shown in FIG. 21, fasteners can be used to install the horizontal mullions to the connecting brace which are attached to the A-Side horizontal mullions. The holes in each end of the B-Side horizontal mullions can be aligned with the alignment pins in the connecting braces and pressed securely into place. Once both ends of the horizontal mullions are fully seated, fasteners can be inserted to secure the connecting brace to the horizontal mullions. Once all the horizontal mullions are installed, the temporary clamping strips can be removed.

Figure 22:
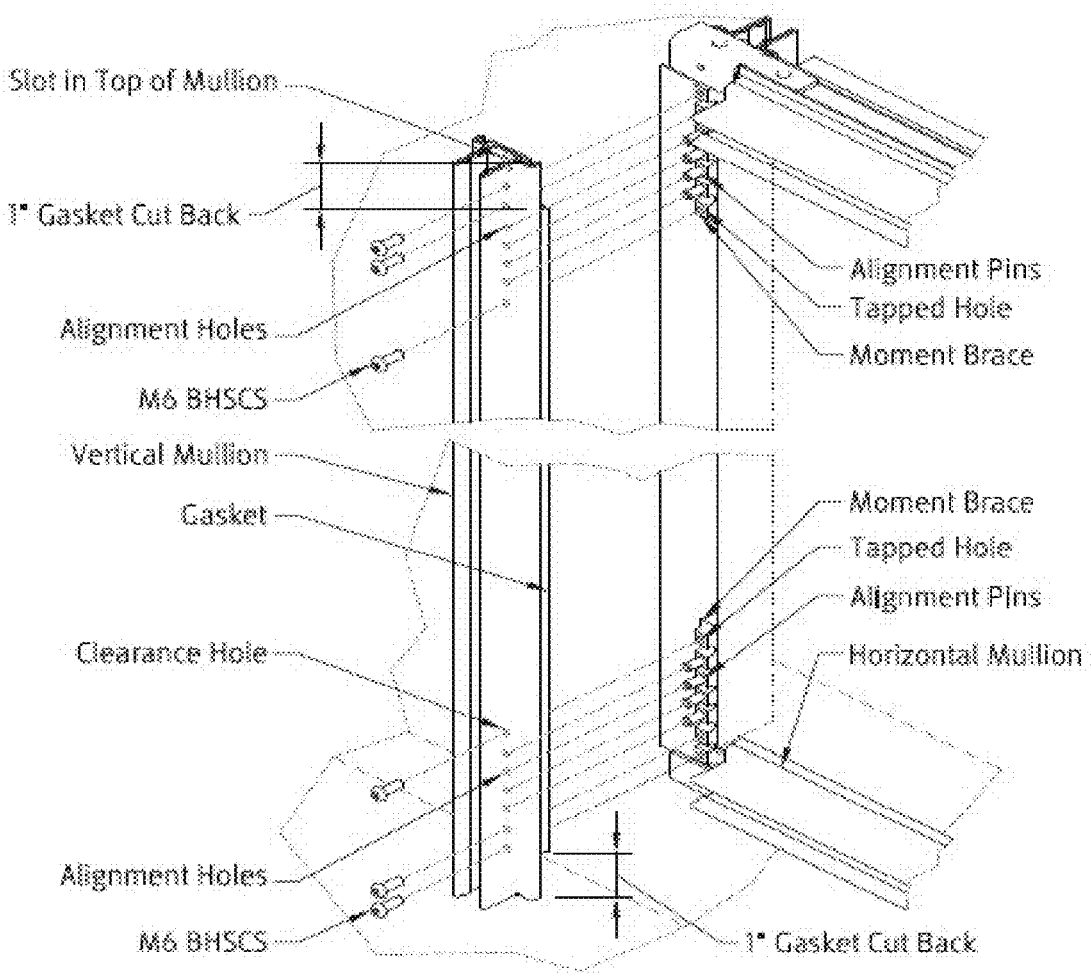
FIG. 22 illustrates an exemplary B-Side vertical mullion installation.

FIG. 22 illustrates an exemplary B-Side vertical mullion installation. As shown in FIG. 22, the holes in each end of the B-Side vertical mullions can be aligned with the alignment pins in the connecting and moment braces and pressed securely into place. One both ends of the vertical mullions are fully seated, fasteners can be inserted as shown in FIG. 22.

Figure 23:
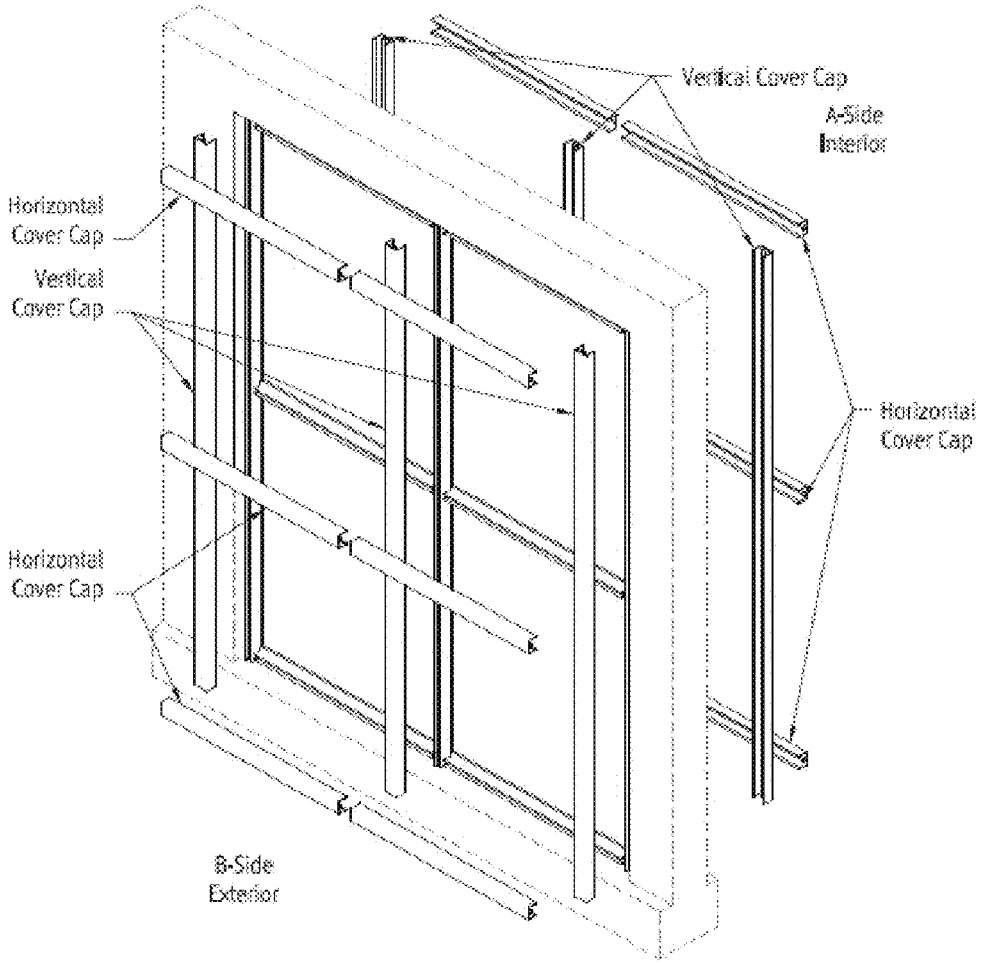
FIG. 23 illustrates the installation of various cover caps on both the A-Side and B-Side of the framing system.
Figure 24:
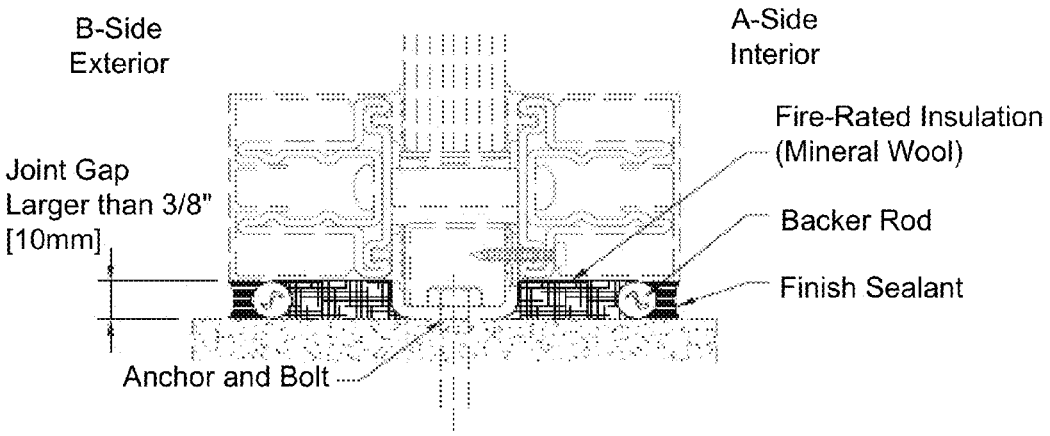
FIG. 24 illustrates a fire-rated installation for joint gaps of ⅜ inches or smaller.
Figure 25:
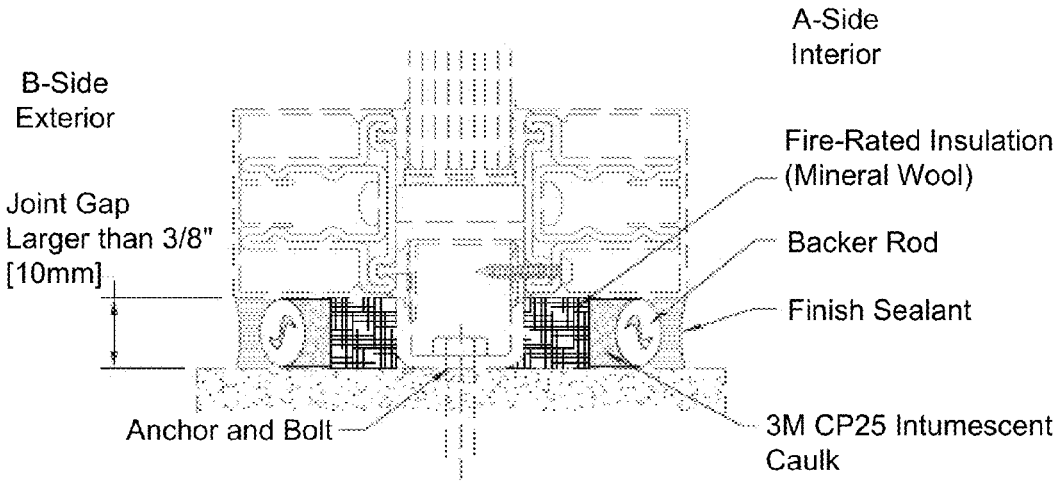
FIG. 25 illustrates a fire-rated installation for joint gaps greater than ⅜ inches.

FIG. 23 illustrates the installation of various cover caps on both the A-Side and B-Side of the framing system. FIG. 24 illustrates a fire-rated installation for joint gaps of ⅜ inches or smaller, while FIG. 25 illustrates a fire-rated installation for joint gaps greater than ⅜ inches.

Figure 26:
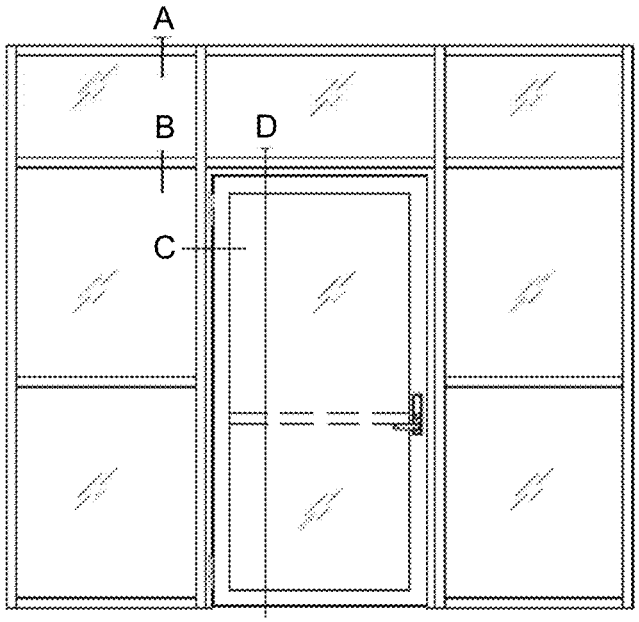
FIG. 26 illustrates an elevation view of a store front system that comprises various horizontal and vertical mullions that support glazing units.
Figure 27A:
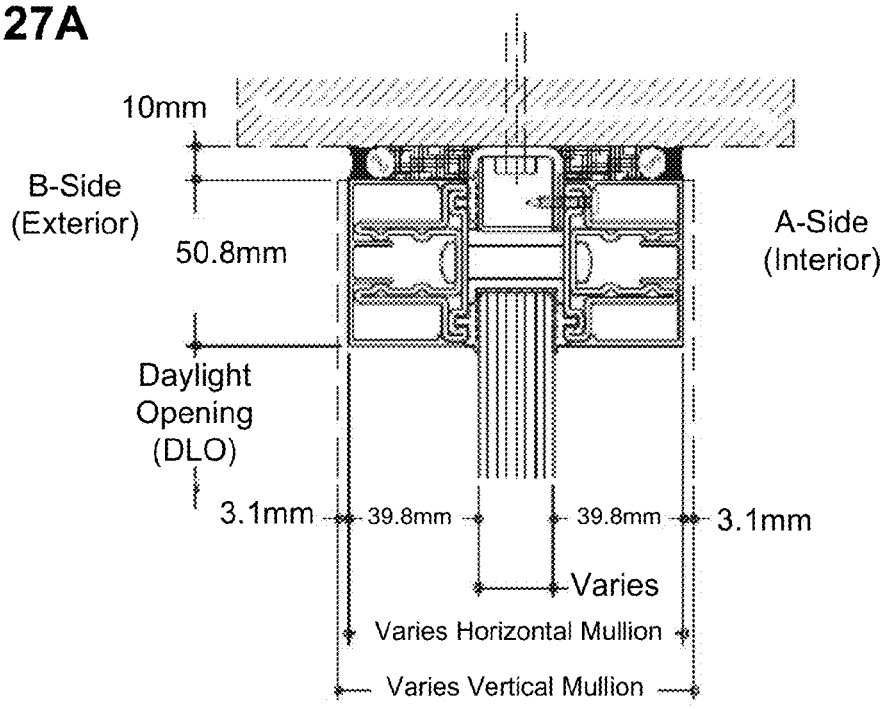
Figure 27B:
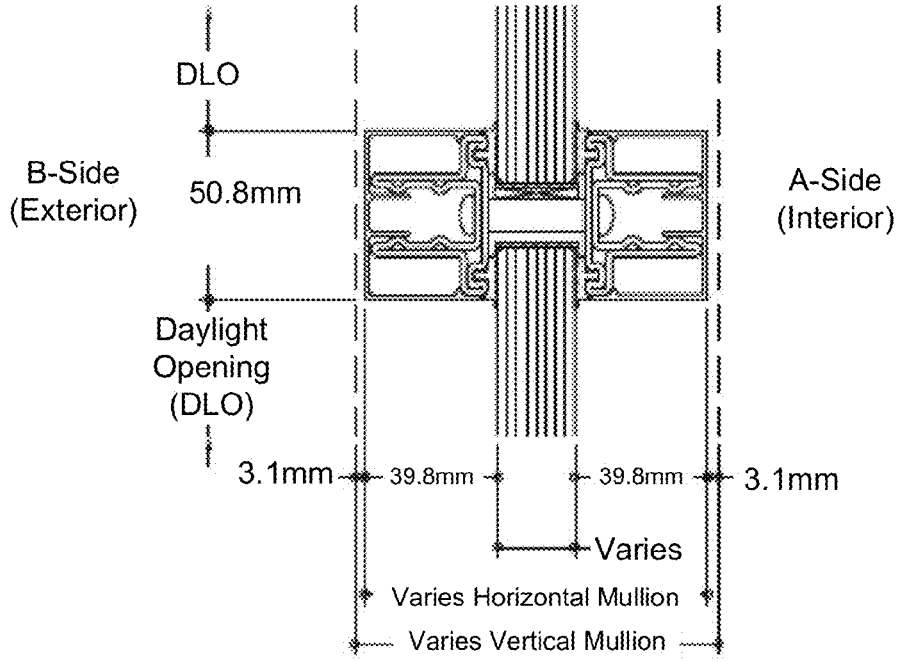

FIG. 26 illustrates an elevation view of a store front system that comprises various horizontal and vertical mullions that support glazing units. FIGS. 27A, 27B, 27C, and 27D illustrate various features of the store front system taken from the areas shown in FIG. 26. For example, FIG. 27A illustrates a head mullion section view, FIG. 27B illustrates a horizontal mullion section view, FIG. 27C illustrates a door and sidelight view, and FIG. 27D illustrates a door and transom view.

In embodiments where the curtain wall systems is intended for exterior use, a structurally glazed curtain wall system can include an insulated glazing unit (i.e., a fire rated glazing unit) spaced apart and coupled to a glass unit.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A structurally-glazed curtain wall system comprising:

a first fire-rated glazing unit coupled to a second fire-rated glazing unit by a framing system, the framing system comprising a plurality of uninsulated vertical mullions with a roll-formed steel profile; and a vertical moment brace that is an all-bolted assembly between mullions, wherein the moment brace is not welded to either mullion, wherein the roll-formed steel profile forms a first wall portion and two projecting wall portions that extend from the first wall portion in a generally perpendicular manner, the respective projecting wall portions comprising a folded profile.

2. The system of claim 1, further comprising a silicone gasket system positioned between the framing system and the respective glazing units.

3. The system of claim 1, further comprising a glass setting platform that is formed as a combination of horizontal and vertical connecting members.

4. The system of claim 1, further comprising intermediate anchors between vertical mullions.

5. The system of claim 1, wherein the insulated glazing unit meets fire barrier and thermal transfer limitations of ASTM-E-119 for a period duration of at least 60 minutes.

6. The system of claim 1, wherein the insulated glazing unit meets fire barrier and thermal transfer limitations of ASTM-E-119 for a period duration of at least 120 minutes.

7. The system of claim 1, wherein the plurality of vertical mullions are spaced apart from one another to form a generally curved surface.

8. A store front system comprising:

a plurality of uninsulated vertical mullions with a roll-formed steel profile;

a plurality of uninsulated horizontal mullions with a roll-formed steel profile;

a plurality of fire-rated glazing units that are positioned between adjacent vertical and horizontal mullions; and a vertical moment brace that is an all-bolted assembly between mullions, wherein the moment brace is not welded to either mullion, wherein the roll-formed steel profile forms a first wall portion and two projecting wall portions that extend from the first wall portion in a generally perpendicular manner the respective projecting wall portions comprising a folded profile.

9. The system of claim 8, further comprising a silicone gasket system positioned between the vertical mullions and adjacent glazing units.

10. The system of claim 8, further comprising a glass setting platform that is formed as a combination of horizontal and vertical connecting members.

11. The system of claim 8, wherein the insulated glazing unit meets fire barrier and thermal transfer limitations of ASTM-E-119 for a period duration of at least 60 minutes.

12. The system of claim 8, wherein the insulated glazing unit meets fire barrier and thermal transfer limitations of ASTM-E-119 for a period duration of at least 120 minutes.

13. The system of claim 8, wherein the plurality of vertical mullions are spaced apart from one another to form a generally curved surface.

* * * * *